United States Patent [19]

Engh

[11] Patent Number: 4,739,588

[45] Date of Patent: Apr. 26, 1988

[54] METHOD AND APPARATUS FOR JOINTING ROTATABLE CUTTER HEADS

[76] Inventor: Harry W. Engh, Box 134, Omak, Wash. 98841

[21] Appl. No.: 857,719

[22] Filed: Apr. 30, 1986

[51] Int. Cl.[4] ..... B24B 3/55

[52] U.S. Cl. ..... 51/246; 51/250; 51/165.79

[58] Field of Search ..... 51/246, 249, 165.79, 51/250

[56] References Cited

U.S. PATENT DOCUMENTS

| | | | |
|---|---|---|---|
| 1,114,743 | 10/1914 | Fosterling | 51/246 |
| 2,440,464 | 4/1948 | Ewaldson | 51/165.79 |
| 2,729,923 | 1/1956 | Durst | 51/249 |
| 2,735,248 | 2/1956 | West | 51/246 |
| 2,788,623 | 4/1957 | Procter | 51/246 |
| 3,331,167 | 7/1967 | Hoch | 51/246 |

FOREIGN PATENT DOCUMENTS

| | | | |
|---|---|---|---|
| 2025285 | 1/1980 | United Kingdom | 51/246 |

*Primary Examiner*—Harold D. Whitehead
*Attorney, Agent, or Firm*—Wells, St. John & Roberts

[57] ABSTRACT

A jointing method and apparatus is described for jointing rotating blades on surfacing machines such as wood planers. The apparatus includes a pair of rods secured to the surfacer framework. An actuator mechanism is slidably mounted to the rods by a pair of bushings. The actuator mechanism carries a jointing stone securely, yet adjustably, for motion along the length of the rods and along the rotating cutter head. The adjustment mechanism is provided such that the stone can be moved in an arc toward and away from the cutter head. This adjustment is facilitated, along with free motion of the stone holder along the guide rods by a single hand wheel operated at a position remote from the rotating cutter head.

5 Claims, 2 Drawing Sheets

METHOD AND APPARATUS FOR JOINTING ROTATABLE CUTTER HEADS

FIELD OF THE INVENTION

The present invention is related to apparatus and method for jointing cutter knives of rotatable cutter heads used in surfacing machines such as lumber planers.

BACKGROUND OF THE INVENTION

Surfacing machines, such as wood planers and jointers, etc., often make use of at least one powered, rotatable cutter head. The cutter head is typically supplied with a number of axial knives presenting sharpened edges along the outward periphery of the cutter head for removing material passed over the rotating head on a workpiece support surface. In wood planers, often two such cutter heads are used to simultaneously perform surfacing operations on opposing surfaces of the wooden workpiece.

The process involved in mounting the cutter knives to rotatable cutter heads is rather complicated and time consuming. It is therefore desirable to periodically recondition or "joint" the knives on the cutter head rather than removing the knives and sharpening each separately.

Proper equipment used in the jointing operation and correct selection of jointing stones are major assets in accomplishing a proper jointing operation.

A skilled worker may have adequate training and expertise to accomplish a quality job, but may well be frustrated in doing so because of equipment shortcomings. For example, a soft jointing stone is almost always preferred over a hard, dense stone. But the soft stones cannot be used due to the pounding action of the rotating knives against the stone if the stone support "flutters." This is a typical situation with most, if not all, present "dovetail" jointer stone support assemblies. A worn or loose fit in the stone support allows the stone support to jum or "flutter" as the knives rotate into engagement with the stone. Soft stones are easily broken in this situation so the less desirable hard stones must be selected.

Another result of stone support flutter is that an undesirable high or outwardly projecting "heel" is created behind the cutting edge of the knives. This "head" does not assist the knives in the cutting or scraping operation, but instead rubs over the surface of the work piece, often causing burns or, at best, a rough textured surface. Nonetheless, the worker must select a hard stone for the jointing process since a soft stone would be surely broken by the fluttering action of the support and contact with the surfacer knives.

A tight or securely mounted stone holder will facilitate the use of softer stones which remove many times more material in a shorter time. However, the presently available jointer devices cannot be effectively "tightened" to provide firm support for the stone without sacrificing freedom of movement for the stone across the cutter head during the jointing oepration. Dovetail stone mounts will not slide freely when secured in a manner sufficient to reduce or eliminate stone flutter. Older, worn jointing devices simply cannot be adjusted tight enough to accomplish the task, even with the inherent sacrifice of mobility of the stone across the cutter head.

The above problems have been recognized to limit degree by the below-referenced United States patents. However, it is not believed that any of the known references show or suggest the solution embodied in the present invention as set forth below.

U.S. Pat. No. 4,495,734 granted to Rauch in 1985 discloses a grinding arrangement for chopping cutters. The grinding arrangement makes use of a tool mounting bar and guide slidably engaged thereon for supporting the grinding stone. A wheel actuator arrangement is provided for driving and guiding the stone to and fro along the axial length of the cutter head. This arrangement, while making use of wheels in the drive arrangement, still makes use of a singular bar and guide way arrangement for mounting the grinder.

U.S. Pat. No. 3,374,699 to Schmermund discloses a sharpening arrangement for mounting cutter heads and for sharpening the cutter heads. The apparatus includes a support frame for receiving and mounting the cutter head for rotation on an axis that is skewed in relation to a grinding tool support. The grinding tool is movably supported on a pair of guide rods for motion along the cutter head. A stone support is mounted on the rod-mounted carriage by a dovetail arrangement to facilitate radial adjustment of the stone against the cutter head to be sharpened.

The rods and bearings mounting the carriage and stone in the Schmermund device may function to eliminate some of the problems present in a standard dovetail guide arrangement but many of these advantages may be offset by use of the dovetail stone support arrangement. It may therefore be concluded that Schmermund, while providing adequate longitudinal support for the jointing stone, teaches away from the solution presently disclosed in this application by using a dovetail stone mounting arrangement for radial adjustment relative to the blade or cutter head to be sharpened.

U.S. Pat. No. 2,476,177 to Bloom et al issued July 12, 1949, discloses a forage harvester knife sharpener. This device again makes use of an elongated bar mounting a stone holder for adjustment toward or away from the cutters on a drum. The entire mechanism is pivotal about a shaft that extends across the width of the harvester cutting head.

U.S. Pat. No. 933,398 to Osborne granted May 30, 1911, discloses a grinder to planer knives also making use of a bar slidably mounting a jointing stone support.

U.S. Pat. No. 267,579 to M. W. Palmer granted Nov. 14, 1882, discloses a planer knife grinder in which a grinding disc is mounted for rotation with an end-supported shaft adjacent a planar knife head. The powered grinding disc can be moved along the length of the rotable signel shaft by an elongated actuator extending to one side of the planer. The Palmer device is intended to sharpen each knife separately and cannot be used effectively with the planer in operation. A somewhat similar apparatus is disclosed in U.S. Pat. No. 2,620;606 to Dvorak, issued Dec. 9, 1952. Dvorak discloses a sharpening attachment for surfaces in which a grinding wheel is mounted by a pivoted frame to a shaft for sliding movement along the cutter head. The cutter head cannot be operated during the sharpening operation.

Of the above references, none are believed to show or suggest a solution to the problem of securing a jointing stone while enabling relatively free precision motion of the stone in relation to a rotating cutter head as described and claimed below.

BRIEF DESCRIPTION OF THE DRAWINGS

A preferred form of the present invention is illustrated in the accompanying drawings, in which.

DETAILED DESCRIPTION OF THE PREFERRED EMBODIMENT

Figure 1:
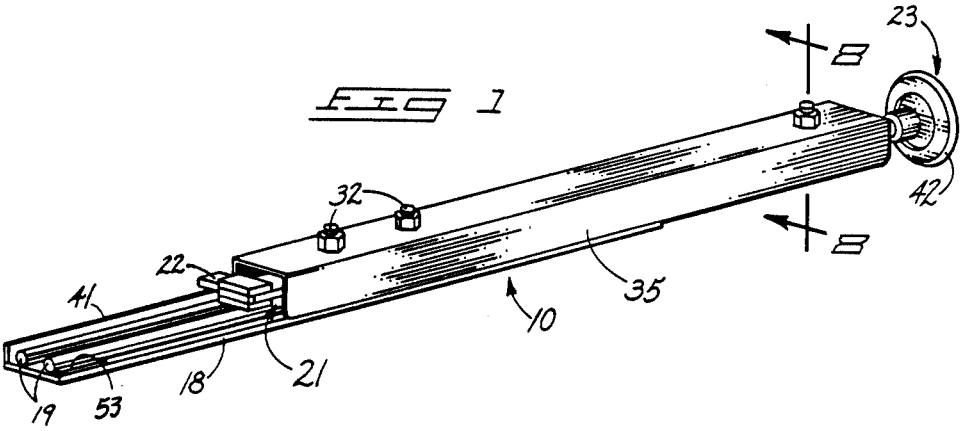
FIG. 1 is a pictorial view of the present apparatus as an attachment for surfacing machines.

In compliance with the constitutional purpose of the Patent Laws "to promote the progress of science and useful arts" (Article 1, Section 8), applicant submits the following disclosure of the invention.

The present invention is embodied in a jointer and method for jointing the blades of rotatable cutter heads on surfacing machines such as wood planers. The jointer may be provided as an attachment to the surface as generally shown in the drawings by the reference character 10. Alternatively, the jointer may be "built in" to new surfacers during manufacture.

Figure 2:
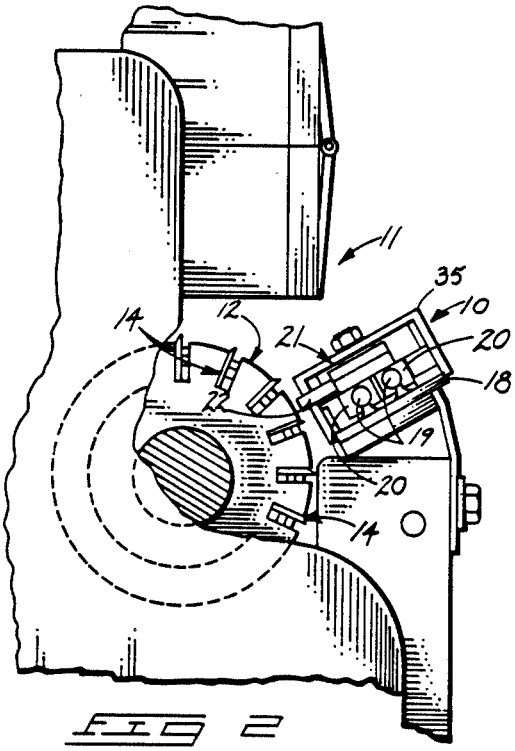
FIG. 2 is an end view of the present apparatus shown mounted to a surfacing machine, the machine being shown diagrammatically.

The present jointer 10 is shown in FIG. 2 mounted to the framework 13 of a planer or other surfacing machine 11 having a rotatable cutter head 12. Cutting knives 14 are mounted about the periphery of cutter head 12 for the purpose of cutting or scraping material from a workpiece (not shown) which is typically moved linearly past the rotating drum or head 12.

Figure 4:
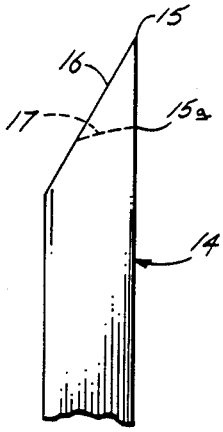
FIG. 4 is a diagrammatic view of a single cutter knife.

A single knife 14 is illustrated in FIG. 4. The knife is shown therein in end view, it being understood that the knife edge 15 will extend the full length of the cutter head 12. The cutting edge 15 of a new blade, if correctly mounted to the head 12, will be equidistant at all points along its length from the rotational axis of the head. As the blades wear with use, however, the sharp edge becomes dulled and nicked along its length. A dull, nicked edge produces a rough texture along the work piece and slows operation of the surfacing machine.

The knife 14 shown in FIG. 4 is initially supplied with a sharpened cutting edge 15 and a "heel" 16 leading from the cutting edge at an approximate 30° angle. Wear and periodic jointing operations, however, will produce a secondary heel 17 and cutting edge 15*a* formed along an arc of a radius to the rotational axis of the cutter head 12. The cutting edge 15*a* leads the secondary heel 17 in performing a cutting or surfacing operation as the surfacer head 12 rotates. It is understandably desirable that the heel 17 not be "raised" or situated radially outward of the cutting edge 15*a*.

The present device and method function to provide a uniform cutting edge 15*a* and adjacent heel 17 along the full length of every knife on the head 12 without requiring removal of the individual knives or the cutter head from the associated surfacing machine 11. In fact, the present apparatus can be used to perform the present method while the cutter head is in operation. That is, the jointing process can be performed while the surfacing machine is surfacing a workpiece. Production need not be slowed or impeded to perform the jointing process.

The present apparatus, when utilized as an attachment, includes rigid elongated base 18. The base 18 may be adapted to be secured rigidly to the frame of the associated surfacer alongside the cutter head 12. The base 18 may be secured by bolts or other appropriate conventional attachment means securely and immovably to the surfacer framework.

A pair of substantially parallel guide rods 19 are provided along the base 18. The rods are preferably ground hardened shafting and are rigidly secured to the base 18 in precise positions thereon in relation to one another and to the surface of base 18.

Figure 9:
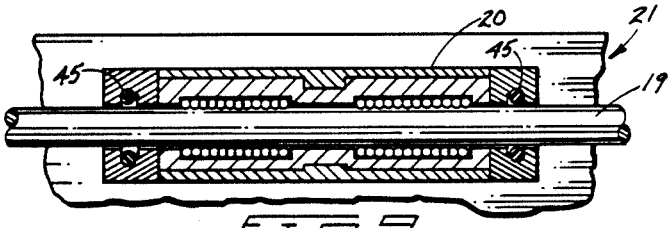
FIG. 9 is an enlarged sectional view taken substantially along line 9—9 in FIG. 5.

The guide rods 19 each receive a precision bushing 20 for free translational motion thereon. A preferred form of bushing 20 is illustrated in section in FIG. 9. It includes one or more races of ball bearings for free rotational engagement with the associated guide rod 19. The bearings will allow relatively free translation motion of the bushing with respect to the rod but will not permit lateral motion.

The bushings 20 are rigidly secured to a stone actuator means generally shown at 21. The stone actuator means 21 is utilized to mount the jointing stone 22 and hold it securely in a selected position for performing the jointing operation. Means 21 is operatively connected to an actuator adjustment means 23 that can be operated from a remote end of the jointer 10 to selectively move the stone and actuator means along the guide rods. The adjusting means 23 can also be operated to move the stone 22 on the actuator means toward or away from the cutter head 12.

Figure 5:
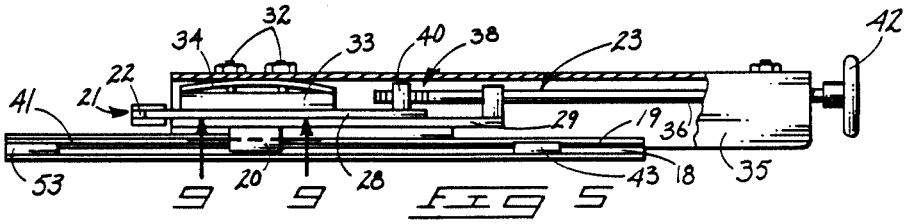
FIG. 5 is a fragmented side elevation view of the present apparatus attachment.
Figure 6:
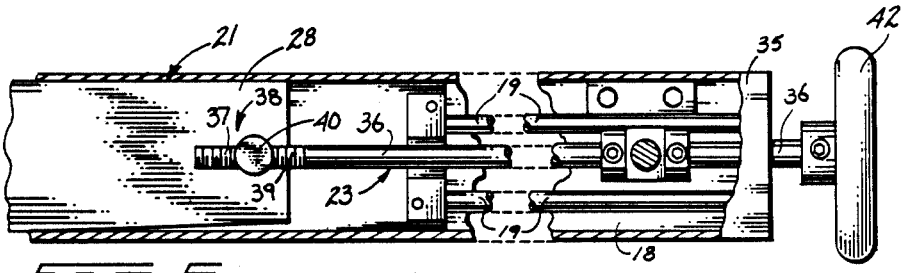
FIG. 6 is a fragmented view illustrating the actuator adjustment mechanism of the present apparatus.
Figure 7:
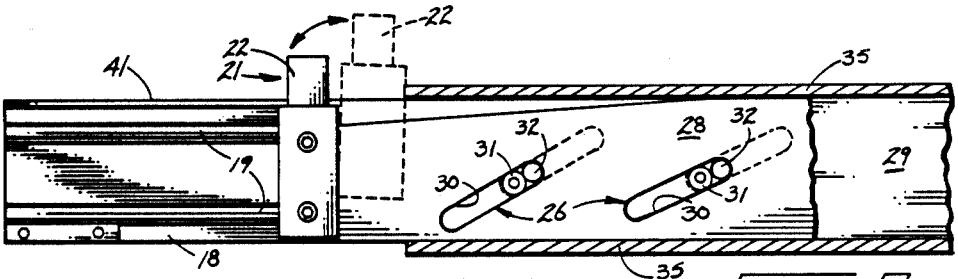
FIG. 7 is a fragmented view illustrating a stone support and actuator means.

The actuator means 21 is shown in substantial detail in FIGS. 5 through 7. It is shown to include means at 26 for guiding the stone in an arcuate path toward and away from the cutter head. Means 26 may include a cam means between the actuator means 21 and adjusting means 23 for guiding the stone in the desired arcuate path in response to operation of the adjusting means 23.

The cam means may be provided in conjunction with a relatively flat actuator plate 28. The plate 28 may be considered a stone mounting plate as it includes an appropriate clamping device at an outward end for securely, yet releasably, mounting a selected stone 22. The actuator plate 28 is slidably mounted to a base or bushing plate 29. A top, flat surface of the bushing plate 29 slidably receives and mounts the actuator plate 28. An opposite, bottom surface of the base or bushing plate 29 rigidly mounts the pair of bushings 20. The plate 29 therefore secures the two bushings 20 in parallel orientation.

Figure 3:
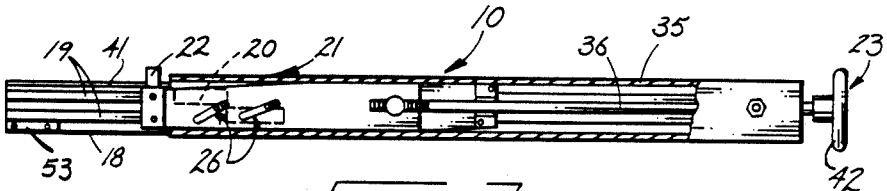
FIG. 3 is a partially fragmented top plan view of the attachment shown in FIG. 1.

The bushings 20, as shown in FIG. 3, are longitudinally spaced from one another along the length of the plate 29. This dual, spaced mounting arrangement increases the resistance to lateral motion of the plate 29. The dual bushings and rods, interconnected by the plate 29, serve to hold the actuator means 21 securely against lateral motion, yet facilitate free movement of the actuator means along the length of the guide rods 19.

The cam means 27 may be comprised of a pair of slots 30 (FIG. 7) formed in the actuator plate 28 and cooperating with a pair of followers 31 on the base plate 29. It is understood, however, that the slots and followers could be interchanged. That is to say the followers 31 could be provided on the actuator plate 28 and the slots 30 could be formed in the base plate 29.

The slots 30 are preferably divergent or unparallel so that longitudinal motion of the actuator plate 28 will result in arcuate movement of the outwardly mounted stone as shown by FIG. 7. The angular relation of slots 30 determine the arcuate travel of the stone. This is desired over a relatively linear motion for the stone. The stone, moving along an arc, will constantly present a fresh surfacing edge to the rotating blades of the cutter head 12. The stone can therefore be used more effectively in the jointing operation. For each slight inward adjustment of the stone, a slight variation in the angular orientation of the stone will occur. This reorientation, though very slight, results in advantages in that the stone will not as quickly "load" with metal from the knives 14 and will not be as quickly formed by the rotating cutter heads.

The followers 31 may be in the form of rotatable bearings removably secured to the base plate 29. Such bearings will permit relatively free motion of the blade as defined by the slots 30. The bearings can also be easily removed and replaced should wear occur.

The actuator plate 28 is slidably sandwiched between the base plate 29 and a bearing, tensioning plate 33 (FIG. 5). Studs 32 extend upwardly from the base plate 29, through cam slots 30, and appropriate apertures in the plate 33 to a rigid cover 35 to threadably receive appropriate nuts. The plate 33 is biases against the actuator plate 28 by tension along the studs 32 and by operation of a spring plate 34 (FIG. 5) secured between the cover 35 and plate 33. The plate 33 and the upper surface of base plate 29 permit relatively free sliding motion of the actuator plate 28 along the plane of the base plate but will resist upward or downward motion as viewed in FIG. 5.

It is noted that the sutds 32 are each aligned with a respective bearing follower 31 in the respective slots 30. This permits the studs to extend through the actuator plate 28 without interfering with the interacting followers and slots.

The cover 35 is elongated and rigid. It is preferably formed in an inverted U configuration as shown in FIGS. 1 and 2. It is secured by the studs 32 to the actuator means 21 for motion to and fro along the length of the relatively stationary rods 19. The cover therefore provides structural stability for the actuator means 21 and covers it against accumulation of debris and pitch, etc., that might otherwise be accumulated along the bushings 20 or remainder of the actuator means 21.

A guard 41 is also provided to prevent accumulation of materials along the rods 19. The guard 41 may be secured to the base 18 along a length of the rods 19 that would otherwise be exposed along the length of the cutter head 12.

The actuator adjusting means 23 is shown in substantial detail in FIG. 6. It may include an elongated adjusting rod 36 having an inward end 37 connected by an appropriate means 38 to the actuator means 21. Means 38 is provided between the actuator plate 28 and the rod end 37 and is responsive to rotational motion of the rod to longitudinally move the plate 28.

Means 38 may be comprised of corresponding threads 39 and a nut 40. The threads 39 may be provided at the rod end 37 and the nut 40 may be pivotably mounted to the actuator plate 28.

Figure 8:
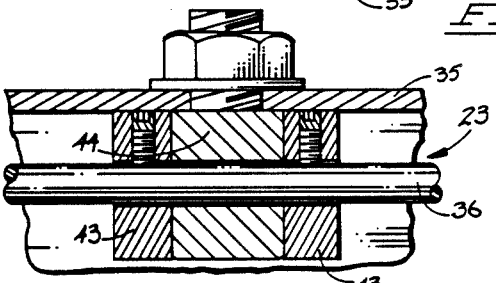
FIG. 8 is an enlarged section view taken substantially along line 8—8 in FIG. 1.

A hand wheel 42 is provided at an opposite outward end of the rod 36. The hand wheel facilitates manual rotation of the rod and also can be used to manually move the actuator means along the length of the guide rods 19. The adjusting rod 36 is held against axial motion relative to the cover 35 by the arrangement shown in detail in FIG. 8. Collars 43 are secured along the length of the rod and sandwich an anchor stud collar 44. The stud of the anchor collar extends through the cover 35 to receive a nut. The anchor collar freely rotatably receives the rod 36. However, the collars 43 are secure on the rod 36 and act against the anchor collar 44 to prevent axial movement of the rod along the cover. The cover thus connects the rod and base plate 29 (via studs 32) such that rotational movement of the rod will cause corresponding axial movement of the nut 40 and the attached actuator plate 28. This motion will be conditioned by the cam means and result in selective adjustable motion of the stone 22 between the positions shown in FIG. 7.

The present process involves first securing the guide rods 19 to the surfacing machine. This is done simply by appropriately fastening the base 18 to the surfacing machine in parallel relation to the rotational axis for the cutter head 12. The base and complete assembly 10 are preferably mounted to the frame of the surfacer such that the stone is oriented substantially radially with respect to the rotational axis of the cutter head 12.

The jointer 10 is of sufficient length that the base will extend along the cutter head and beyond to one side of the surfaces where the hand wheel 42 will be located safely away from the dangerous blades 14.

Next, the stone is adjusted into a working position by operation of the adjusting means 23 in relation to the cutter head. This may be done by selectively rotating the hand wheel 42 at the outward end of the cover 35. It is again noted that this adjustment can be performed at a safe distance from the cutter head which may be rotating at the time.

The hand wheel 42 is turned until the stone just touches the rotating knives. As the adjustment occurs, the stone is moved in the arcuate path described above toward the cutter head 12.

The actuator means 21 securely holds the stone in the selected position while the hand wheel may be used manually to move the actuator means. This is accomplished by pushing and pulling the actuator means from the hand wheel 42 along the length of the guide rods 19 back and forth between appropriate stops 53 on the base 18 along the full length of the rotating cutter head 12.

The various provisions of the actuator means described in detail above function to securely hold the stone in position against flutter during this step. Since there is no stone flutter, the operator may select a relatively soft stone for the jointing operation.

A soft stone as described above includes the inherent advantage of fast and effective removal of material from the jointing knives. In fact, it has been found that operation of the present device with a soft stone will reduce the overall time required for the jointing operation by approximately five times over the time required previously for the jointing operation using hard stones and the old "dovetail" stone holding mechanisms.

Furthermore, the adjustment provision for arcuately moving the stone toward the rotating cutter head presents a "new" stone surface to the rotating knives for each inward adjustment. This feature also contributes to the fast and effective jointing operation.

It is pointed out that the entire operation described above is completed clear of the rotating cutter head. This provides notable safety advantages in that the operator is not required to reach over or into the area adjacent the rotating knives. Both inward stone adjustment and axial stone motion (with respect to the rotating cutter head 12) may be accomplished using only one hand at the hand wheel 42. Radial adjustment of the stone is accomplished by rotating the wheel 42 while axial motion of the stone along the length of the rotating drum is accomplished simply by pushing and pulling the hand wheel along the guide rods 19. The bushings 20 facilitate free motion of the actuator means and stone 22 along the rods while precisely and securely holding the stone against flutter.

The cover 35 and guard 41 protect the rods 19 and bushings 20 against accumulation of debris or materials that might be thrown from the rotating cutter head. This represents an additional advantage over old "dovetail" jointing arrangements which would tend to accumulate deposits thrown from the cutter head along the critical guiding surfaces. In the case of lumber planers, the dovetail guides would accumulate pitch thrown from the rotating cutter heads. The sticky material would bind between the dovetail guide and tool carrier, inhibiting proper operation and detracting from accuracy. Diesel oil or fuel oil was often used to wash accumulated pitch from the dovetail guides. This creates a hazardous situation in which the fuel oil can drip into the contact area between the knives and wood. If sufficient friction exists between the usually improperly jointed knives and wood, sufficient heat may be created to start a fire.

The present rod and bushing arrangement assembly can be used effectively without requiring any of the above hazardous clean-up operations due to the protective nature of the cover 35 and the guard 41. Additionally, the bushings may include integral wipers 45 that will clean the rod 19 as the actuator means is moved along the rod lengths.

In compliance with the statute, the invention has been described in language more or less specific as to structural features. It is to be understood, however, that the invention is not limited to the specific features shown, since the means and construction herein disclosed comprise a preferred form of putting the invention into effect. The invention is, therefore, claimed in any of its forms or modifications within the proper scope of the appended claims, appropriately interpreted in accordance with the doctrine of equivalents.

I claim:

1. A jointer for a surfacing machine having a rotary cutter head with axial knives powered to rotate about a cutter head axis and having a support framework adjacent the cutter head, the jointer attachment comprising:

a pair of rigid cylindrical guide rods;

base means for mounting the guide rods on the support framework such that the cylindrical guide rods are substantially parallel to the cutter head axis;

stone actuator means for securely mounting a jointing stone thereon;

at least two elongated precision bushings slidably mounted to the guide rods and mounting the stone actuator means for free translational axial motion along the lengths of the guide rods while preventing lateral movement of stone actuator means thereon; and actuator adjusting means operatively connected to the stone actuator means for selectively moving the stone and actuator means along the guide rods and for selectively moving the stone actuator means such that a stone carried thereby may be selectively adjusted toward or away from the rotary cutter head from a position remote from the stone actuator means and with the stone actuator means being at any selected location along the length of the guide rods;

wherein the actuator means is comprised of a stone mounting plate means for securely mounting a jointing stone and a bushing plate means mounted to the elongated precision bushings for movably mounting the stone mounting plate means;

cam means between the stone mounting plate means and bushing plate means for moving the stone mounting plate means toward and away from the cutter head responsive to relative longitudinal motion of the plate means to one another and to the guide bars;

wherein the actuator adjusting means includes an actuator plate adjusting rod having one end connected to one of said plate means and extending therefrom along the guide rods to an outward end;

means between said one plate means and said one end of said adjusting rod, responsive to rotational motion of said plate adjusting rod for longitudinally moving said one plate means; and wherein said cam means is comprised of divergent slots and interfitting followers interconnecting the stone mounting plate means and bushing plate means, said divergent slots begin formed in one of said plate means and the interfitting followers being mounted to the other plate means.

2. The jointer as claimed by claim 1 wherein the divergent slots and interfitting followers are oriented such that the stone mounting plate will move in an arcuate path responsive to operation of the actuator adjusting means.

3. The jointer of claim 1 wherein said precision bushings are comprised of elongated ball bearing bushings mounted for free motion along the guide rods and wherein the ball bearing bushings are longitudinally staggered along the guide rods to add lateral stability to the stone actuator means.

4. The jointer of claim 1 further comprising pitch shield means on the base and spanning a length of the guide rods for shielding the guide rods.

5. The jointer as claimed by claim 1 wherein said means responsive to rotational motion of said plate adjusting rod is comprised of:

threads at said one rod end; and a nut on said one plate threadably receiving said threads.

* * * * *